US006536941B1

(12) United States Patent
Fang

(10) Patent No.: US 6,536,941 B1
(45) Date of Patent: Mar. 25, 2003

(54) WRIST-WORN PERSONAL FLASH DISK

(75) Inventor: Chih-Ping Fang, Keelung (TW)

(73) Assignee: Huashuay Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 10/131,328

(22) Filed: Apr. 24, 2002

(51) Int. Cl.[7] ..... G04B 37/00; G04B 37/12
(52) U.S. Cl. ..... 368/281; 368/278; 368/282
(58) Field of Search ..... 368/278, 281–282

(56) References Cited

U.S. PATENT DOCUMENTS 5,337,290 A * 8/1994 Ventimiglia et al. ..... 368/10
5,615,179 A * 3/1997 Yamamoto et al. ..... 368/281
5,813,026 A * 9/1998 Borg et al. ..... 711/115

* cited by examiner

*Primary Examiner*—David Martin
*Assistant Examiner*—Michael L. Lindinger
(74) *Attorney, Agent, or Firm*—William E. Pelton, Esq.

(57) ABSTRACT

A personal flash disk for wrist wearing is disclosed. The main body has double enclosed space for setting a flash memory module and an accessory. Two interlocking straps extend in opposing directions from the main body, wherein multiple punched holes are defined through the first strap, while a buckle is fixed on the second strap. A strap carrier is attached on the second strap that can be adjusted to suitable position to accommodate the connector at one end of the first strap when the personal disk is worn on the wrist but not in use. When the personal disk is to be used, the connector is taken out and plugged into a host computer to make the connection. By incorporating a timepiece or ornamental piece, the personal disk provides a multi-function product with additional values.

7 Claims, 7 Drawing Sheets

WRIST-WORN PERSONAL FLASH DISK

BACKGROUND OF THE INVENTION

1. Field of the Invention

The present invention relates to a wrist-worn personal flash disk, in particular, a personal disk that can be worn on the wrist and integrating a timepiece or ornamental piece into the main body to create a multi-function product.

2. Description of Related Arts

Hitherto the digital technology has been extensively employed in the consumer electronics. Many conventional electronic products have now been converted to the digital means, such as digital cameras, digital voice recording pens, etc, not to mention a variety of new digital products coming out such as the personal digital assistants (PDAs) and portable disks. Data access is much more convenient when data are stored in digital formats, because different types of files can be simultaneously read from or saved on the mass storage media, no matter whether they are for graphic, database or network applications. However, one is likely to encounter a common problem that the data disk runs out of storage space, when one has large amounts of data to be saved. Back in the IBM™ PC era, a portable floppy disk with 1.4 MB of storage capacity was quite enough for most applications. But a graphic image captured by a digital camera may take up hundreds of KBs or even more disk space. A conventional floppy disk is clearly no longer adequate to meet the requirements of digital image processing. In recent years, flash memory technology has made great strides. A type of flash disk called Easy Disk™ has been developed in the past year, which is just a regular portable disk. Its storage capacity in the range of 10–20 MB, though not as large as a hard disk, is already many times the storage capacity of a floppy disk. As shown in FIG. 7, this kind of portable disk has a USB connector (71) for input/output data interface, which only needs to be plugged into the USB port of a desktop or notebook computer to establish a data link with a host computer so that data in the portable disk can be read or written. To create a portable disk, a clipper (72) is designed at the back of a disk body (70) for attaching onto the waistband or pockets of trousers, but it is neither very graceful nor a firm attachment. The chance of losing the portable disk is quite real when running or doing more vigorous exercises, for which a better solution is proposed in the present invention.

SUMMARY OF THE INVENTION

The main object of the present invention is to provide a personal disk that can be worn on the wrist like a timepiece or ornamental piece, while still keeping the original function and appearance of the accessory, thus making it a multi-function product with good portability.

The above mentioned personal disk in accordance with the present invention includes a main body with double enclosed space for accommodating a flash memory module and another accessory.

The memory module is actually flash memory, wherein the data I/O of the memory module is attached to a data line through which memory read/write can be performed by a host computer so connected.

A strap set is composed of a first strap and a second strap, which extend in opposite directions from lateral sides of the main body. The personal disk has adopted a highly portable design by creating multiple punched holes in the first strap and a buckle on the second strap, so that the first strap only needs to be inserted through the buckle at the end of the second strap allowing the buckle hook to be engaged in one of the punched holes on the surface of the first strap when fastening the personal disk on the wrist. Thus, the procedure of wearing a personal disk is just like a wristwatch.

A strap carrier is attached onto the first strap for holding the connector at one end of the first strap when the personal disk is buckled up. It is also a connector plug for protection against dust when not in use.

A personal accessory is fixed in the other enclosure of the main body by an appropriate means, so that it can be placed on the front of the personal disk to provide additional functionality besides the personal disk. The accessory could either be either a timepiece or an ornamental piece.

At appropriate locations on the periphery of the main body a pilot light and a switch-mode button are respectively mounted, wherein the switch-mode button is connected to the internal memory module for controlling the memory operation mode, and the pilot light is to display the current operation status.

The features and structure of the present invention will be more clearly understood when taken in conjunction with the accompanying figures.

DETAILED DESCRIPTION OF THE PREFERRED EMBODIMENT

The present invention provides a personal disk that can be worn on the wrist, and a regular timepiece, ornamental piece or personal accessories can be integrated into the main body to make it a multi-functional product.

Figure 1:
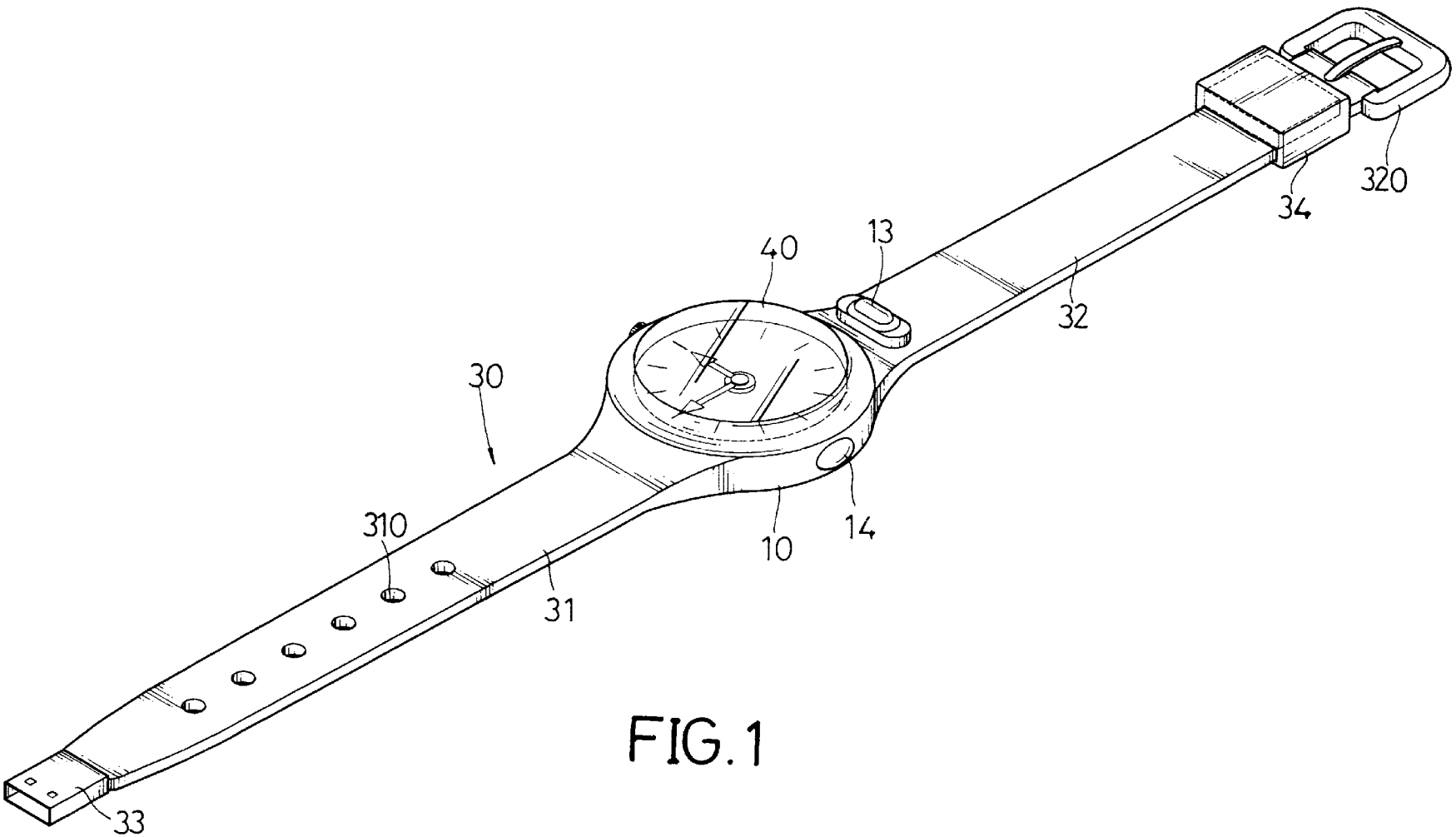
FIG. 1 is an external perspective view of the present invention.
Figure 2:
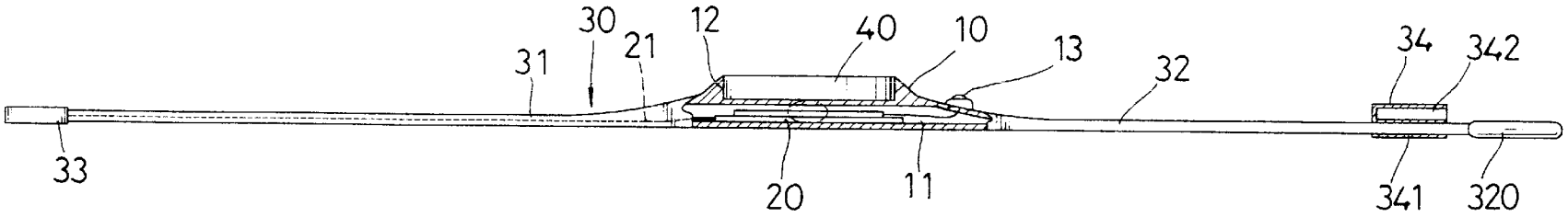
FIG. 2 is a cross-sectional diagram of the invention.

Referring to the figures and particularly FIGS. 1 and 2, the above mentioned personal disk in accordance with the present invention includes a main body (10) with double enclosed space, a memory module (20), a strap set (30) and an accessory (40).

The main body (10) has multiple enclosures, where a double enclosure is designed according to the preferred embodiment. The first enclosure (11) at the bottom is adapted to fit the memory module (20), while the second enclosure (12) at the top is adapted to set the accessory (40). At appropriate locations on the periphery of the main body a pilot light (13) and a switch-mode button (14) are respectively mounted.

The memory module (20) embodied as a flash memory module is incorporated into the first enclosure (11), wherein one or more output terminals are connected to the pilot light (13) in order to display the operation status of the memory module (20), and one or more input terminals are connected to the switch-mode button (14) mounted on the periphery of the main body to select either read/write or read-only operation mode. The data input/output of the memory module (20) is connected to a data line (21) for establishing a data link with a host computer.

The strap set (30) is composed of a first strap (31) and a second strap (32), which are extended out in opposite directions from the lateral sides of the main body (10). The first strap (31) has multiple holes (310) in the surface of the strap, and the second strap (32) has a buckle (320) fixed on the free end, whereby the personal disk (10) can be buckled onto the wrist by means by inserting the first strap (31) through the buckle (320) and allowing the buckle hook to be engaged in one of the holes (310). The procedure of wearing a personal disk on the wrist is similar to that of a wristwatch.

The first strap (31) has a data line (21) enclosed and an interfacing connector (33) on its free end for making data connection with a host computer. The data signal interface in the preferred embodiment is in conformance with USB standard, so that the personal disk (10) can be readily connected to a host computer through the interfacing connector (33) and the data line (21), allowing the computer to access the memory data within the personal disk (10).

Figure 3:
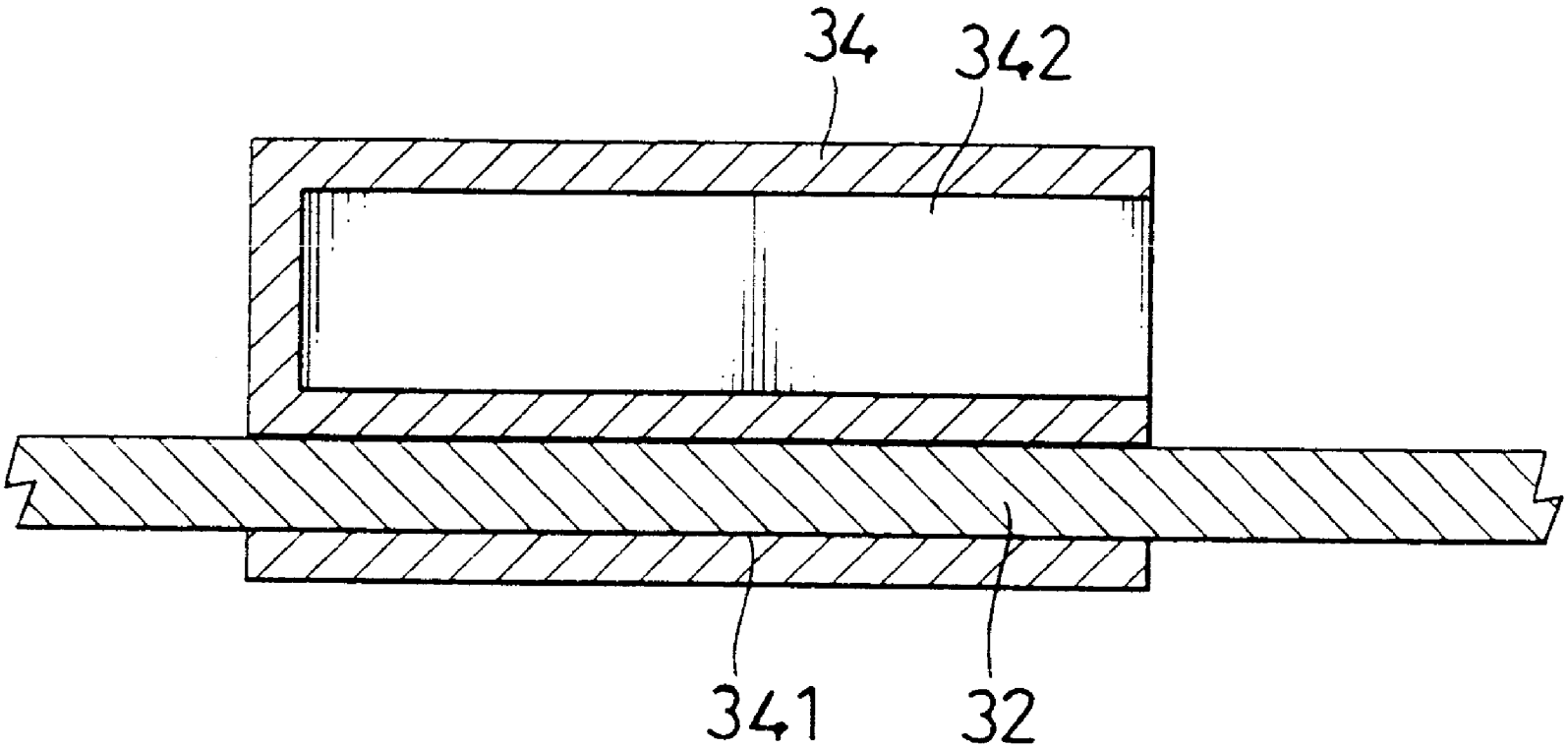
FIG. 3 is a cross-sectional structural view of the strap carrier.
Figure 4:
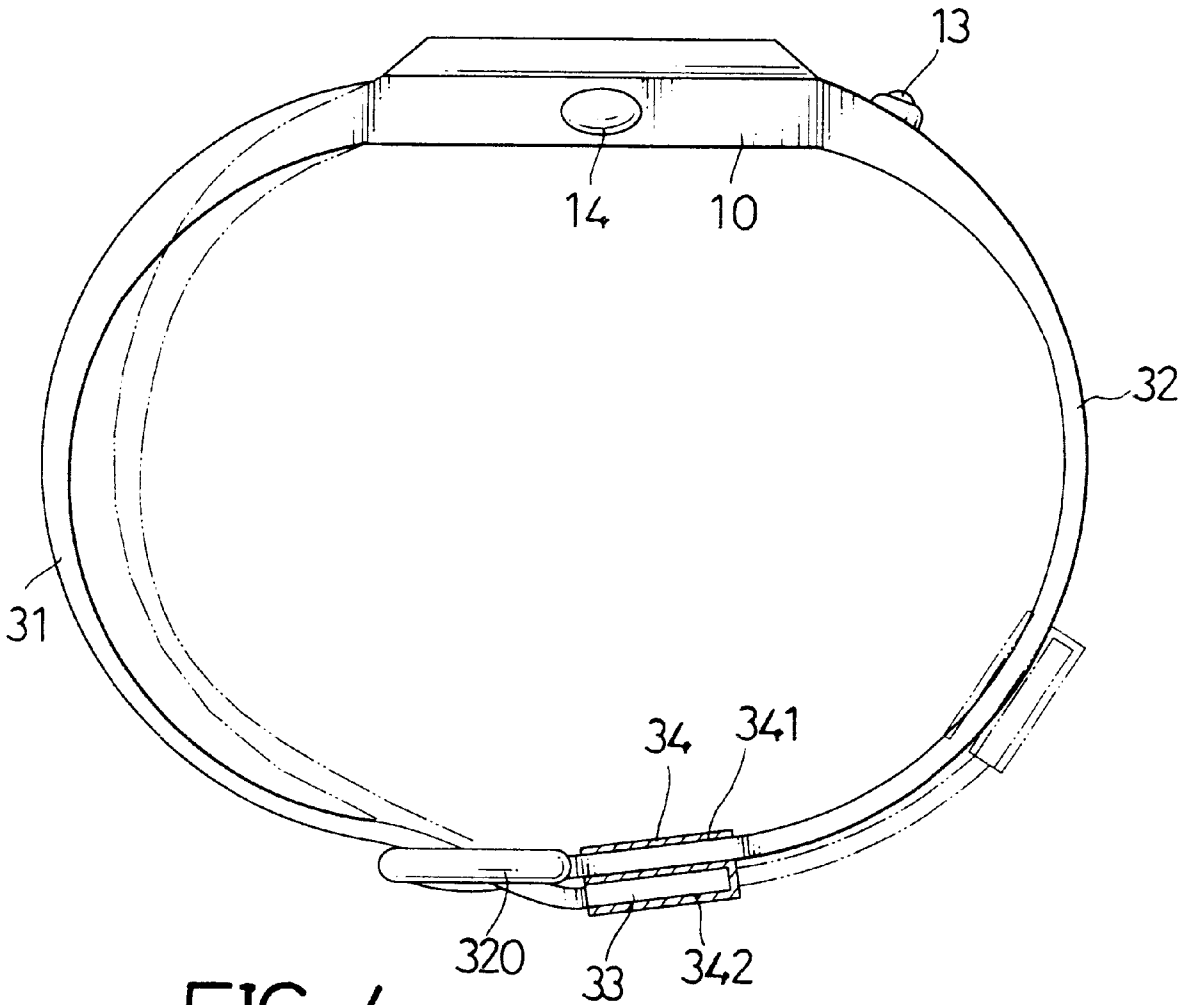
FIG. 4 shows a personal disk buckled up on the wrist in accordance with the present invention.
Figure 5:
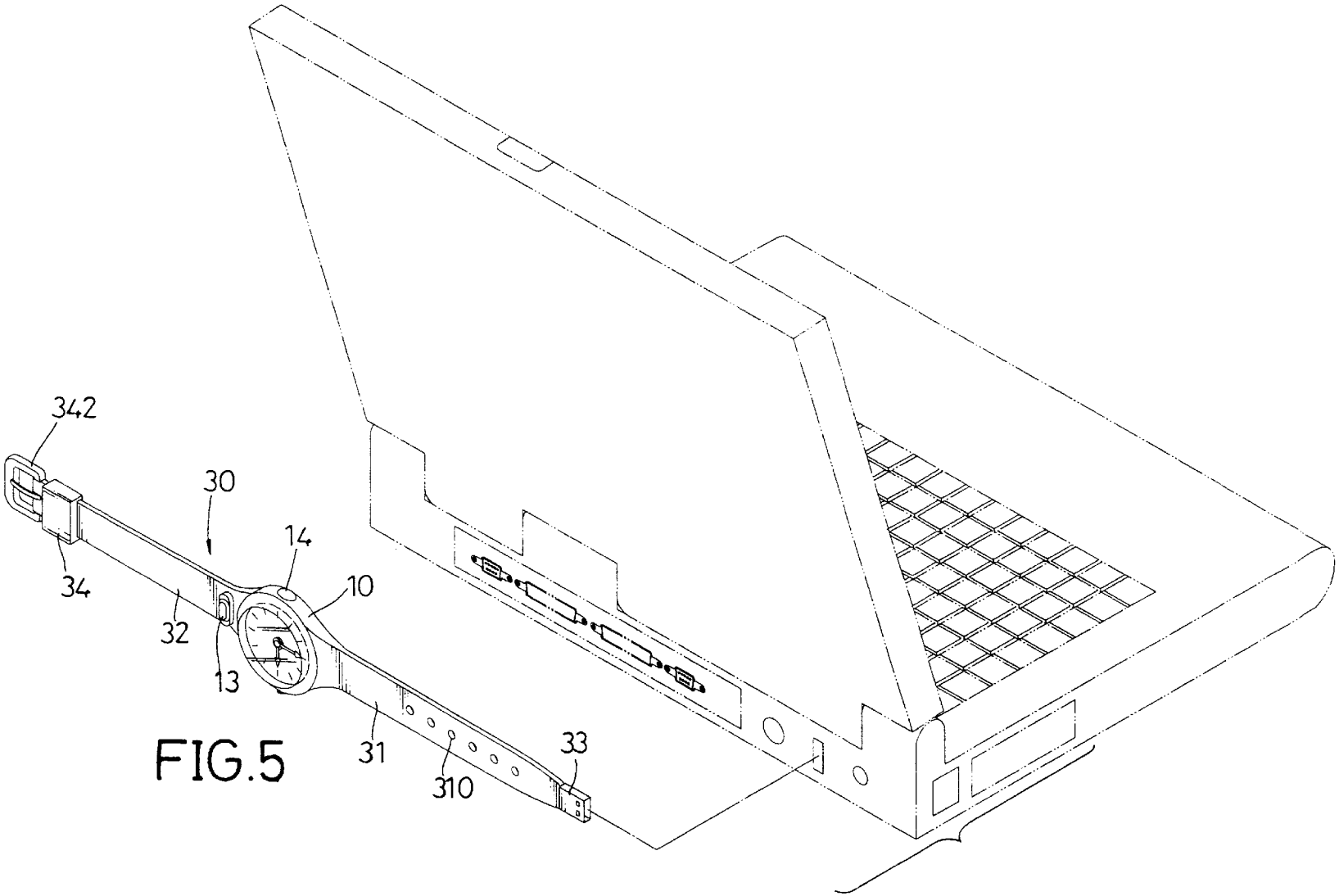
FIG. 5 shows the data link between the personal disk and a notebook computer.
Figure 6:
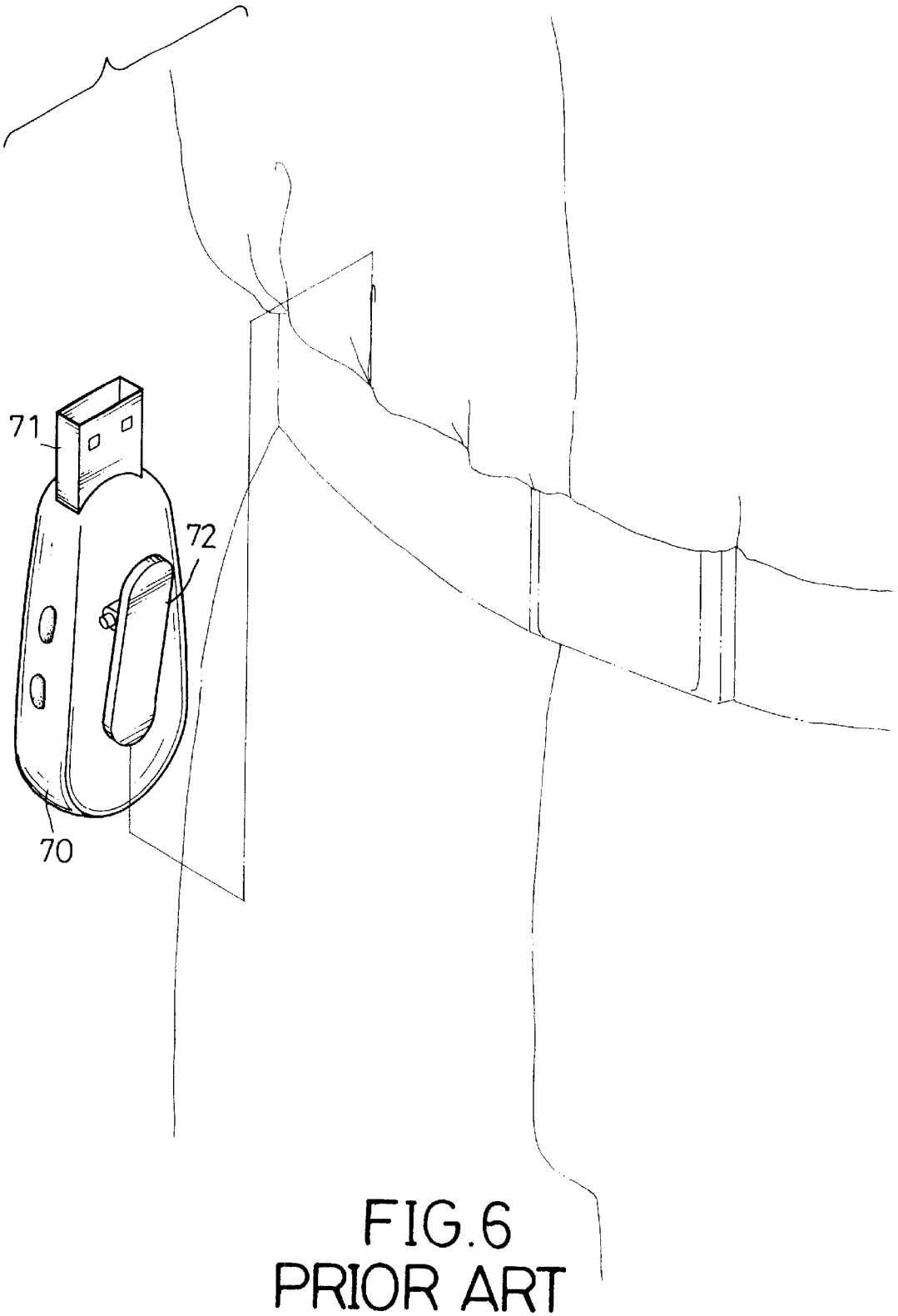
FIG.6 PRIOR ART
FIG. 6 shows a schematic diagram of a conventional personal disk clipping onto the waistband or front or back pocket of trousers.
Figure 7:
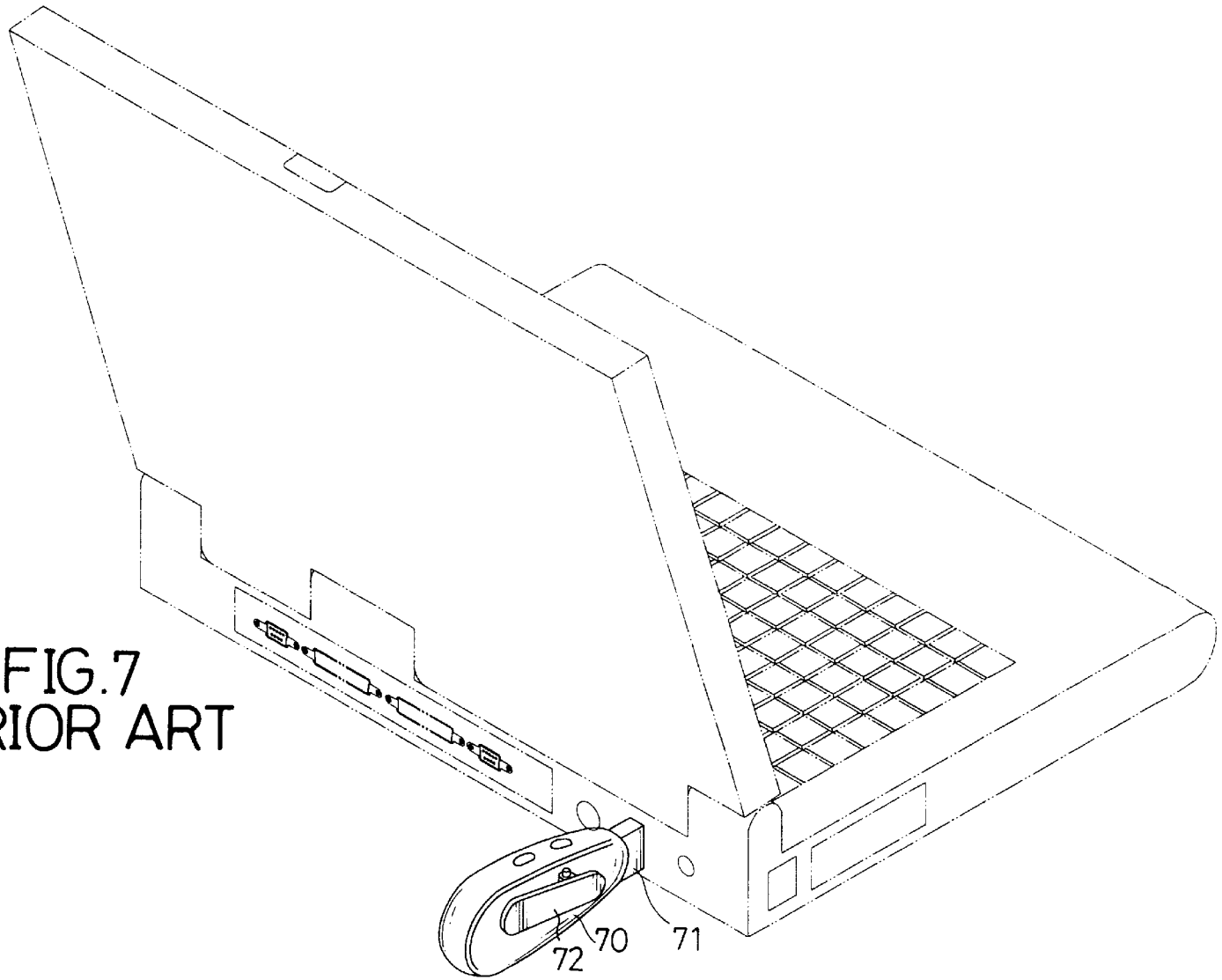
FIG. 7 PRIOR ART
FIG. 7 shows the data link between the conventional personal disk and a notebook computer.

A strap carrier (34) is attached to the second strap (32) as shown in FIG. 3, wherein a lower space (341) defined in the carrier (34) is attached to the strap (32) and allows the strap to run through. An upper space (342) defined in the carrier (34) serves as a holder for the connector (33) from the first strap (31) when the straps are buckled up, and it is also a connector plug for protection against dust when not in use.

The accessory (40) is to be set into the second enclosure (12) by an appropriate means as shown in FIG. 2. A timepiece, an ornamental piece, a compass, or a pace counter can be suitably fitted in the enclosed space (12). In the preferred embodiment a timepiece, mechanical or electronic, is integrated into the main body (10).

The personal disk not only provides a convenient data storage media but could also be used as a regular timepiece, ornament, pace counter or any other object that could be incorporated into the personal disk, under the original design of the present invention. Considering traditional wearing habits, these objects are to be worn on the wrist regardless of the personal disk and therefore would not create any extra burden for the disk users. The present invention creates a multi-functional product by incorporating a regular timepiece or ornamental piece in the structural design of the personal disk. Furthermore, the present invention provides an easy link between the personal disk (10) and a host computer following the path from the memory module (20) and the data line (21) enclosed in the first strap (31) through the interfacing connector (33) to the host computer. Once the data link is successfully established, data can be read from or written to the memory module (20) just like any other hard disk.

From the foregoing, it is clear that the personal flash disk in accordance with the present invention is a new design for this type of product, in consideration of its streamlined body and enhanced functionality.

The foregoing description of the preferred embodiment of the present invention is intended to be illustrative only and, under no circumstances, should the scope of the present invention be so restricted.

What is claimed is:

1. A wrist-worn personal flash disk comprising:

a main body having a first enclosure and a second enclosure;

a memory module set into the first enclosure, wherein the memory module is connected with a data line;

a strap set composed of a first strap and a second strap, wherein the first strap and the second strap are extended out in opposite directions to each other from the lateral sides of the main body, wherein the data line is enclosed in the first strap and an interfacing connector is mounted on one end of the first strap for adapting to connect with a host computer, wherein the interfacing connector is connected to the memory module via the data line; and an accessory receivable in the second enclosure of the main body.

2. The wrist-worn personal flash disk as claimed in claim 1, wherein the first enclosure near a bottom of the main body is for accommodating the memory module, and the second enclosure at a top of the main body is for integrating an accessory.

3. The wrist-worn personal flash disk as claimed in claim 1, wherein the accessory is a timepiece.

4. The wrist-worn personal flash disk as claimed in claim 2, wherein the accessory is an ornamental piece.

5. The wrist-worn personal flash disk as claimed in claim 1, wherein a pilot light and a switch-mode button are mounted at the periphery of the main body, the pilot light and the switch-mode button are respectively connected to an output terminal and an input terminal of the memory module.

6. The wrist-worn personal flash disk as claimed in claim 1, wherein multiple holes are defined through the first strap, and a buckle is fixed on a free end of the second strap, such that the first strap can be inserted through the buckle allowing the buckle to be engaged in one of the multiple holes when the personal disk is to be fastened on the wrist.

7. The wrist-worn personal flash disk as claimed in claim 6, wherein a strap carrier attached to the second strap is defined with an upper space and a lower space, such that the second strap is allowed to run through the lower space, and the upper space serves as a holder for the interfacing connector from the first strap when the personal disk is buckled up.

* * * * *